US010714019B2

(12) United States Patent
Yuan et al.

(10) Patent No.: US 10,714,019 B2
(45) Date of Patent: Jul. 14, 2020

(54) BRIGHTNESS COMPENSATION METHOD FOR DISPLAY APPARATUS, AND DISPLAY APPARATUS

(71) Applicants: BOE Technology Group Co., Ltd., Beijing (CN); Hefei Xinsheng Optoelectronics Technology Co., Ltd., Anhui (CN)

(72) Inventors: Zhidong Yuan, Beijing (CN); Can Yuan, Beijing (CN); Zhenfei Cai, Beijing (CN); Yongqian Li, Beijing (CN); Dongxu Han, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 56 days.

(21) Appl. No.: 15/989,746

(22) Filed: May 25, 2018

(65) Prior Publication Data

US 2019/0066601 A1 Feb. 28, 2019

(30) Foreign Application Priority Data

Aug. 25, 2017 (CN) ..... 2017 1 0749622

(51) Int. Cl.
*G09G 3/3275* (2016.01)
*G09G 3/3266* (2016.01)
(Continued)

(52) U.S. Cl.
CPC ..... *G09G 3/3275* (2013.01); *G09G 3/3266* (2013.01); *G09G 3/3233* (2013.01);
(Continued)

(58) Field of Classification Search
CPC .... G09G 3/3275; G09G 3/3266; G09G 3/204; G09G 3/3225; G09G 3/2025;
(Continued)

(56) References Cited

U.S. PATENT DOCUMENTS 8,624,807 B2 * 1/2014 Miyake ..... G09G 3/3266 345/204
2009/0244050 A1 * 10/2009 Yamamoto ..... G09G 3/3233 345/212
(Continued)

FOREIGN PATENT DOCUMENTS

CN 100444225 C 12/2008
CN 103327275 A 9/2013
(Continued)

OTHER PUBLICATIONS

First Office Action dated Feb. 2, 2019 corresponding to Chinese application No. 201710749622.8.

*Primary Examiner* — Christopher E Leiby
(74) *Attorney, Agent, or Firm* — Nath, Goldberg & Meyer; Joshua B. Goldberg

(57) ABSTRACT

A brightness compensation method for a display apparatus, and a display apparatus are disclosed. The brightness compensation method includes: for each row of display units, turning on the row S times during a display time of one frame; inputting, to each display unit in the row a pixel data signal of the frame corresponding to the display unit, when the row is turned on for the i-th time; inputting, to a to-be-compensated display unit in the row, a compensation signal, and controlling other display unit than the to-be-compensated display unit in the row to present black, when the row is turned on for each time other than the i-th time; wherein both S and i are integers, S≥2, 1≤i≤S; for every two
(Continued)

adjacent rows of display units, a time interval of same turning-ons of the latter and the former is the same.

14 Claims, 3 Drawing Sheets

(51) Int. Cl.
*G09G 3/36* (2006.01)
*G09G 3/3233* (2016.01)

(52) U.S. Cl.
CPC ..... *G09G 3/3677* (2013.01); *G09G 2310/061* (2013.01); *G09G 2320/0233* (2013.01); *G09G 2320/064* (2013.01); *G09G 2360/145* (2013.01)

(58) Field of Classification Search
CPC ..... G09G 2320/0233; G09G 2320/064; G09G 2320/045; G09G 2320/0247; G09G 2320/0261; G09G 2360/145; G09G 2360/18; G09G 2360/16
See application file for complete search history.

(56) References Cited

U.S. PATENT DOCUMENTS

2009/0278775 A1 11/2009 Ha et al.
2011/0069096 A1* 3/2011 Li ..... G09G 3/2081 345/690
2013/0201223 A1* 8/2013 Li ..... G09G 3/2022 345/690
2015/0054862 A1* 2/2015 Kaplan ..... G09G 3/2022 345/691
2016/0104422 A1* 4/2016 Kishi ..... G09G 3/3233 345/205
2017/0372657 A1* 12/2017 Yamamura ..... G09G 3/3233

FOREIGN PATENT DOCUMENTS

CN 106935187 A 7/2017
KR 1020060041045 A 5/2006

* cited by examiner

BRIGHTNESS COMPENSATION METHOD FOR DISPLAY APPARATUS, AND DISPLAY APPARATUS

CROSS-REFERENCE TO RELATED APPLICATION

This application claims the benefit of priority to Chinese Patent Application No. 201710749622.8 filed on Aug. 25, 2017, the contents of which are incorporated herein in their entirety by reference.

TECHNICAL FIELD

The present disclosure relates to the field of display technology, and particularly relates to a brightness compensation method for a display apparatus and a display apparatus.

BACKGROUND

Organic light emitting diode (abbreviated as "OLED") displays have been widely used in various electronic devices including electronic products such as computers, mobile phones, etc., due to their advantages such as self-luminescence, light weight and small thickness, low power consumption, high contrast, high color gamut, and capability of flexible display.

A display panel in an OLED display apparatus mainly relies on OLED devices to emit light so as to achieve normal image display. However, due to differences in fabrication process and differences in characteristics of the OLED devices themselves, the OLED devices at difference positions of the display apparatus may have different luminous efficiencies, and thus, non-uniformity in light emission from the display apparatus is likely to occur.

SUMMARY

Embodiments of the present disclosure provide a brightness compensation method for a display apparatus and a display apparatus.

In an aspect, an embodiment of the present disclosure provides a brightness compensation method for a display apparatus, the display apparatus including n rows of display units, where n is an integer greater than or equal to 2, wherein the brightness compensation method includes: for each row of display units, turning on the row of display units S times during a display time of one frame of image; inputting, to each display unit in the row of display units, a pixel data signal of the frame of image corresponding to the display unit, when the row of display units are turned on for the i-th time; inputting, to a to-be-compensated display unit in the row of display units, a compensation signal, and controlling other display unit than the to-be-compensated display unit in the row of display units to present black, when the row of display units are turned on for each time other than the i-th time; wherein both S and i are integers, $S \geq 2$, $1 \leq i \leq S$; and for every two adjacent rows of display units, a time interval between same turning-ons of the latter row and the former row is the same.

Here, for the row of display units, the display time of one frame of image is a time between a time when the row of display units are turned on for the $(m \times S+1)$-th time and a time when the row of display units are turned on for the $((m+1) \times S+1)$-th time, where m is an integer no less than 0.

In an embodiment, S equals to 2 or 3.

In an embodiment, the step of inputting, to each display unit in the row of display units, a pixel data signal of the frame of image corresponding to the display unit when the row of display units are turned on for the i-th time includes: inputting, to each display unit in the row of display units, a pixel data signal of the frame of image corresponding to the display unit when the row of display units are turned on for the first time.

In an embodiment, in the case that S equals to 2: a time interval t1 between the first turning-on and the second turning-on of the row of display units equals to $$\frac{L2}{L1}T;$$

where L1 and L2 are brightness values respectively outputted by a first display unit and a second display unit in the case that the first display unit and the second display unit are applied with a same pixel data, and L1>L2; T is the display time of one frame; the second display unit is the to-be-compensated display unit in the second turning-on, and the first display unit is other display unit than the to-be-compensated display unit. Alternatively, in the case that S equals to 3: a time interval t1 between the first turning-on and the second turning-on of the row of display units equals to $$\frac{L3}{L1}T;$$

a time interval t2 between the second turning-on and the third turning-on of the row of display units equals to $$\left(\frac{L3}{L2}-\frac{L3}{L1}\right)T;$$

where L1, L2 and L3 are brightness values respectively outputted by a first display unit, a second display unit, and a third display unit in the case that the first display unit, the second display unit and the third display unit are applied with a same pixel data, and L1>L2>L3; T is the display time of one frame; the second display unit is the to-be-compensated display unit in the second turning-on, the third display unit is the to-be-compensated display unit in the second turning-on and the third turning-on, and the first display unit is other display unit than the to-be-compensated display unit.

In an embodiment, the display apparatus includes a plurality of data lines, the plurality of data lines are refreshed $S \times n$ times during the display time of one frame of image; and in the time interval between the same turning-ons of any two adjacent rows of display units, the data lines are refreshed $(S-1)$ times.

In an embodiment, the method further includes a step of determining the to-be-compensated display unit, and the step includes:

inputting a same pixel data to all the display units of the display apparatus so that the display apparatus displays a detection image;

obtaining, by an image sensor, brightness values of the display units in the detection image; and determining the to-be-compensated display unit based on the brightness values.

In an embodiment, determining the to-be-compensated display unit based on the brightness values includes: determining a display unit whose brightness value is less than a preset threshold value to be the to-be-compensated display unit.

In an embodiment, determining the to-be-compensated display unit based on the brightness values includes: dividing the display apparatus into display areas having different brightnesses according to different brightness value ranges that are preset; and determining a display unit that is in a display area having a small brightness value to be the to-be-compensated display unit.

In an embodiment, for the n rows of display units, only one row of display units are turned on at the same time.

In another aspect, embodiments of the present disclosure provide a display apparatus including n rows of display units, where n is an integer greater than or equal to 2, the display apparatus further includes: a scan driving circuit configured to, for each row of display units, turn on the row of display units S times during a display time of one frame of image; and a data driving circuit configured to input, to each display unit in the row of display units, a pixel data signal of the frame of image corresponding to the display unit through data lines, when the row of display units are turned on for the i-th time; wherein the data driving circuit is further configured to input, to a to-be-compensated display unit in the row of display units, a compensation signal through the data lines, and controlling other display unit than the to-be-compensated display unit in the row of display units to present black, when the row of display units are turned on for each time other than the i-th time; wherein both S and i are integers, $S \geq 2$, $1 \leq i \leq S$; for every two adjacent rows of display units, a time interval between same turning-ons of the latter row and the former row is the same.

In an embodiment, for the row of display units, the display time of one frame is a time between a time when the row of display units are turned on for the $(m \times S+1)$-th time and a time when the row of display units are turned on for the $((m+1) \times S+1)$-th time, where m is an integer no less than 0.

In an embodiment, the scan driving circuit includes S scan driving sub-circuits configured to, for each row of display units, sequentially turn on the row of display units S times during the display time of one frame of image, and the S scan driving sub-circuits turn on only one row of display units at the same time.

In an embodiment, S equals to 2 or 3.

In an embodiment, the data driving circuit is configured to input, to each display unit in the row of display units, a pixel data signal of the frame of image corresponding to the display unit when the row of display units are turned on for the first time.

In an embodiment, in the case that S equals to 2: a time interval t1 between the first turning-on and the second turning-on of the row of display units equals to $$\frac{L2}{L1}T;$$

where L1 and L2 are brightness values respectively outputted by a first display unit and a second display unit in the case that the first display unit and the second display unit are applied with a same pixel data, and L1>L2; T is the display time of one frame; the second display unit is the to-be-compensated display unit in the second turning-on, and the first display unit is other display unit than the to-be-compensated display unit. Alternatively, in the case that S equals to 3: a time interval t1 between the first turning-on and the second turning-on of the row of display units equals to $$\frac{L3}{L1}T;$$

a time interval t2 between the second turning-on and the third turning-on of the row of display units equals to $$\left(\frac{L3}{L2}-\frac{L3}{L1}\right)T;$$

where L1, L2 and L3 are brightness values respectively outputted by a first display unit, a second display unit, and a third display unit in the case that the first display unit, the second display unit and the third display unit are applied with a same pixel data, and L1>L2>L3; T is the display time of one frame; the second display unit is the to-be-compensated display unit in the second turning-on, the third display unit is the to-be-compensated display unit in the second turning-on and the third turning-on, and the first display unit is other display unit than the to-be-compensated display unit.

In an embodiment, the data lines are refreshed $S \times n$ times by the data driving circuit during the display time of one frame of image; and in the time interval between the same turning-ons of any two adjacent rows of display units, the data lines are refreshed $(S-1)$ times.

In an embodiment, the display apparatus further includes a to-be-compensated display unit determining module including an image sensor and a processor, wherein the data driving circuit inputs a same pixel data to all the display units of the display apparatus so that the display apparatus displays a detection image;

the image sensor is configured to obtain brightness values of the display units in the detection image; and the determination unit is configured to determine the to-be-compensated display unit based on the brightness values.

In an embodiment, the determination unit is configured to determine a display unit whose brightness value is less than a preset threshold value to be the to-be-compensated display unit, or divide the display apparatus into display areas having different brightnesses according to different brightness value ranges that are preset; and determine a display unit that is in a display area having a small brightness value to be the to-be-compensated display unit.

BRIEF DESCRIPTION OF THE DRAWINGS

In order to explain technical solutions in embodiments of the present disclosure or the prior art more clearly, drawings to be used in description of the embodiments or the prior art will be briefly introduced below. Apparently, the drawings illustrate only some embodiments of the present disclosure, and for a person of ordinary skill in the art, other drawings can be obtained based on these drawings without creative effort.

DETAILED DESCRIPTION

The technical solutions in the embodiments of the present disclosure will be described clearly and fully below in conjunction with the accompanying drawings in the embodiments of the present disclosure. Apparently, the embodiments described herein are merely a part, rather than all, of the embodiments of the present disclosure. On the basis of the embodiments of the present disclosure, all other embodiments obtained by a person of ordinary skill in the art without creative effort should fall into the protection scope of the present disclosure.

Embodiments of the present disclosure provide a brightness compensation method for a display apparatus. The display apparatus includes n rows of display units (it should be understood that n is an integer greater than or equal to 2). The brightness compensation method includes:

for each row of display units, turning on (scanning) the row of display units S times during a display time T of one frame of image; inputting, to each display unit in the row of display units, a pixel data signal of the frame of image corresponding to the display unit, when the row of display units are turned on for the i-th time; inputting, to a to-be-compensated display unit in the row of display units, a compensation signal, and controlling other display unit than the to-be-compensated display unit in the row of display units to present black, when the row of display units are turned on for each time other than the i-th time. Here, $S \geq 2$, $1 \leq i \leq S$, the i-th time is one of the S times; for every two adjacent rows of display units, a time interval between same turning-ons of the latter row and the former row is the same. That is, the time interval between the first turning-on of the latter row and the first turning-on of the former row, the time interval between the second turning-on of the latter row and the second turning-on of the former row, . . . , and time interval between the S-th turning-on of the latter row and the S-th turning on of the former row are all the same. It is to be noted that, for one row of display units, "the display time T of one frame of image" as used herein may be a time between a time when the row of display units are turned on for the $(m \times S+1)$-th time and a time when the row of display units are turned on for the $((m+1) \times S+1)$-th time, where m is an integer no less than 0. For example, in the case of S=2, the display time T of one frame of image may be a time between a time when one row of display units are turned on for the first time and a time when the row of display units are turned on for the third time, a time between a time when the row of display units are turned on for the third time and a time when the row of display units are turned on for the fifth time, and so on.

Figure 1:
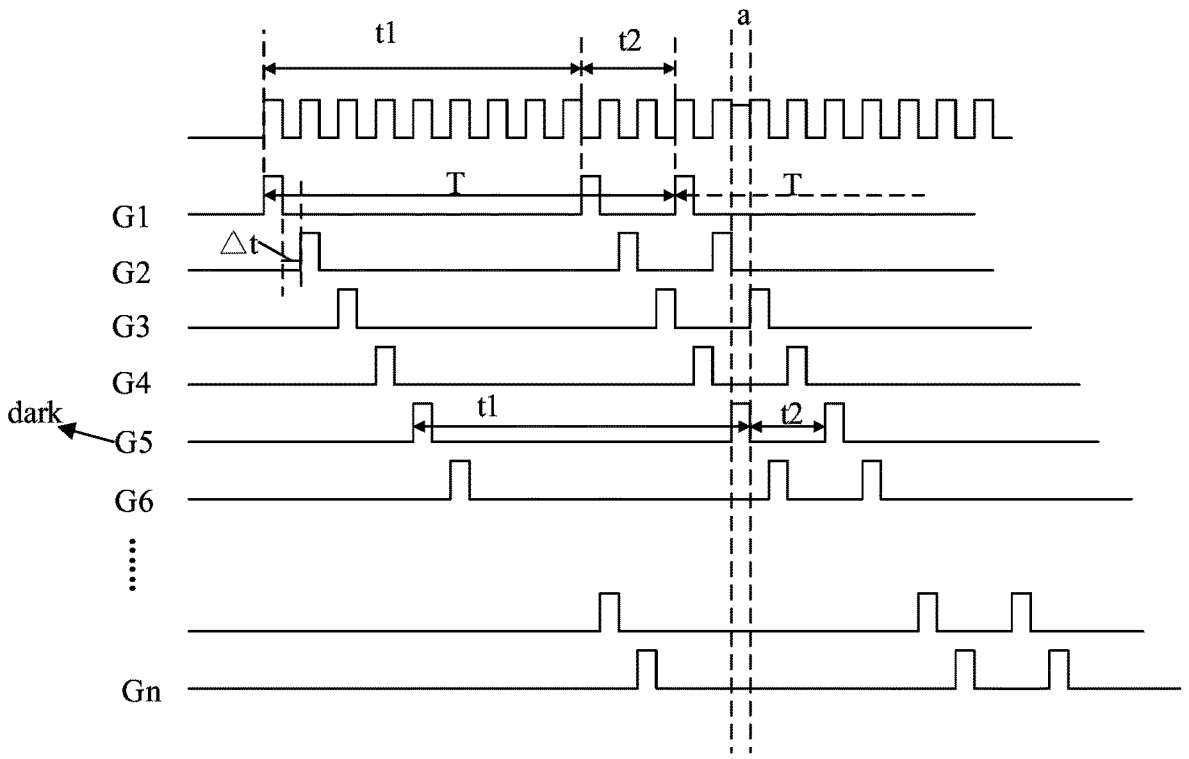
FIG. 1 is a schematic diagram of a brightness compensation method for a display apparatus provided in an embodiment of the present disclosure.
Figure 2:
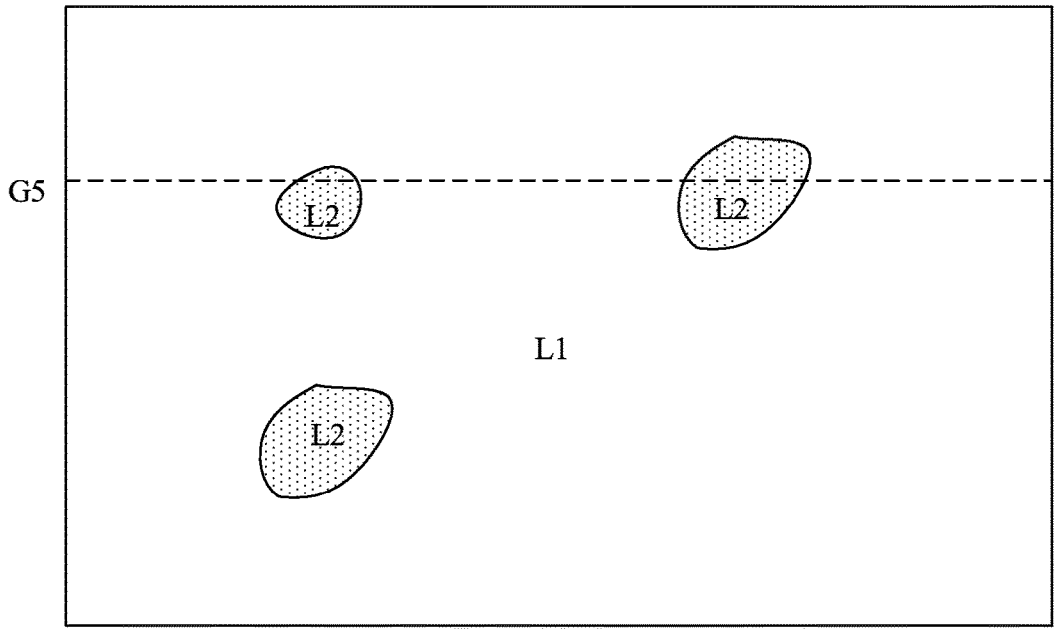
FIG. 2 is a schematic diagram illustrating brightness distribution of a display apparatus before brightness compensation in an embodiment of the present disclosure.

In one embodiment, as shown in FIG. 1, each row of display units are turned on twice during the display time T of one frame. As shown in FIG. 2, there is a to-be-compensated display unit that is insufficiently luminous (i.e., relatively dark) in the fifth row of display units (i.e., display units connected to a scan line G5 in FIG. 2) in the display apparatus.

In this case, referring to FIG. 1, when the fifth row of display units are turned on for the first time, a pixel data signal of the frame of image corresponding to each display unit may be inputted to the display unit in the row of display units; when the row of display units are turned on for the second time, a compensation signal may be inputted to a to-be-compensated display unit in the row of display units, and any display unit other than the to-be-compensated display unit in the row of display units is controlled to present black. That is to say, for the fifth row of display units, during the display time T of one frame of image, all of the display units perform image display normally (i.e., display the frame of image together) in a time interval t1 between the first turning-on and the second turning-on; the to-be-compensated display unit is compensated by additionally inputted compensation signal (i.e., continues performing image display according to the inputted compensation signal), whereas each display unit other than the to-be-compensated display unit is controlled to present black (i.e., no longer performs image display), in a time interval t2 between the second turning-on and the first turning-on for the next frame of image.

Figure 3:
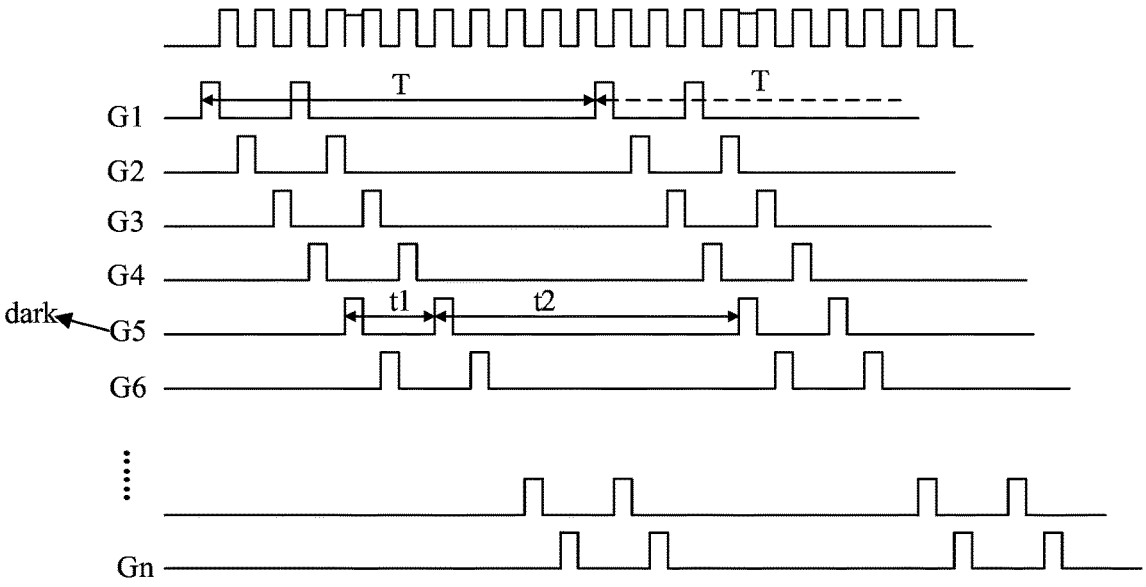
FIG. 3 is a schematic diagram of a brightness compensation method for a display apparatus provided in an embodiment of the present disclosure.

In one embodiment, referring to FIG. 3, it is also possible to firstly input the compensation signal to the to-be-compensated display unit in the fifth row of display units and control each display unit other than the to-be-compensated display unit in the row of display units to present black when the row of display units are turned on for the first time, and input, to each display unit in the row of display units, a pixel data signal of the frame of image corresponding to the display unit when the row of display units are turned on for the second time. That is to say, for the fifth row of display units, during the display time T of one frame of image, the to-be-compensated display unit is compensated by the inputted compensation signal (i.e., performs image display according to the inputted compensation signal), and other display unit than the to-be-compensated display unit is controlled to present black (i.e., does not perform image display), in the time interval t1 between the first turning-on and the second turning-on for the current frame of image; all of the display units perform image display normally (i.e., display the frame of image together) in the time interval t2 between the second turning-on for the current frame of image and the first turning-on for the next frame of image.

Therefore, in the present disclosure, for each row of display units, the pixel data signal corresponding to each display unit in the row of display units is inputted to the respective display unit in which turning-on among the S turning-ons, i.e., the value of i, is not specifically limited. Based on a conventional display method, however, as shown in FIG. 1, when the row of display units are turned on for the first time, the pixel data signal corresponding to each display unit in the row of display units is inputted to the respective display unit, that is, the value of i is 1.

It should be noted that, the display unit in the present disclosure may be a sub-pixel unit, or a pixel unit, which is not limited in the present disclosure. The step of inputting, to each display unit in the row of display units, a pixel data signal of the frame of image corresponding to the display unit when the row of display units are turned on for the i-th time may be understood as, when the n rows of display units are sequentially turned on row by row for the i-th time, each of n rows of display units that are sequentially turned on is applied with pixel data of the frame of image corresponding to the display units in the row.

In the step of inputting, to the to-be-compensated display unit in the row of display units, the compensation signal and controlling other display unit than the to-be-compensated display unit to present black when the row of display units are turned on for any time other than the i-th time, if the row of display units are all the to-be-compensated display units, a compensation signal is inputted to each of the display units in the row; if there is no to-be-compensated display unit in the row, all of the display units in the row are controlled to present black. Needless to say, if a part of the display units in the row are the to-be-compensated display units, a compensation signal is inputted to each to-be-compensated display unit among the display units in the row, and other display units than the to-be-compensated display units are controlled to present black. For the to-be-compensated display unit, the compensation signal may be the same as the pixel data signal of the frame of image corresponding to the display unit. In this way, when inputting the compensation signal, the to-be-compensated display unit displays the pixel data of the frame of image corresponding to the display unit. It can be understood that, the display apparatus in the present disclosure may be a liquid crystal display (LCD) apparatus, or may be an organic light emitting diode (OLED) display apparatus, which is not limited in the present disclosure.

For different types of display apparatuses, the way to "control other display unit than the to-be-compensated display unit to present black" may be different to a certain extent. For example, for an OLED display apparatus, a data driving signal onto other display unit than the to-be-compensated display unit may be controlled to be zero (a voltage signal of 0V), so that the display unit at this position (i.e., the position of the display unit other than the to-be-compensated display unit) will not emit light (i.e., be black). For an LCD apparatus, depending on whether the LCD apparatus is in a normally black mode or a normally white mode, a data driving signal onto other display unit than the to-be-compensated display unit is selectively controlled to be zero or not to be zero, so that the display unit at this position (i.e., the position of the display unit other than the to-be-compensated display unit) does not emit light (i.e., presents black). In the embodiments of the present disclosure, an OLED display apparatus is taken as an example to describe the above brightness compensation method.

In summary, the brightness compensation method in the present disclosure is based on the principle that brightness sensed by human eyes is the integration of an actual brightness of the display unit over time. In the brightness compensation method according to the present disclosure, light emitting time of the display unit in a relatively dark area (i.e., the to-be-compensated display unit) is prolonged, so that as compared with a display unit in a relatively bright area, the display unit in the relatively dark area continues to emit light for a corresponding compensated light emitting time after normally emitting light for a same time. In this way, as a whole, the brightness of the display unit in the relatively dark area sensed by human eyes is the same as the brightness of the display unit in the relatively bright area sensed by human eyes, thus alleviating the problem of non-uniformity in light emission of the display apparatus.

Hereinafter, determination of the to-be-compensated display unit and determination of the compensation time for the to-be-compensated display unit in the present disclosure will be further explained.

Firstly, the to-be-compensated display unit may be determined by determining brightness values of the display units.

In one embodiment, a same pixel data may be inputted to all of the display units of the display apparatus so that the display apparatus displays a detection image; then brightness values of the display units in the detection image may be obtained by an image sensor such as a charge-coupled device (CCD), and the display unit having a relatively small brightness value (e.g., the display unit having a brightness value smaller than a preset threshold value) is determined as the to-be-compensated display unit.

Figure 5:
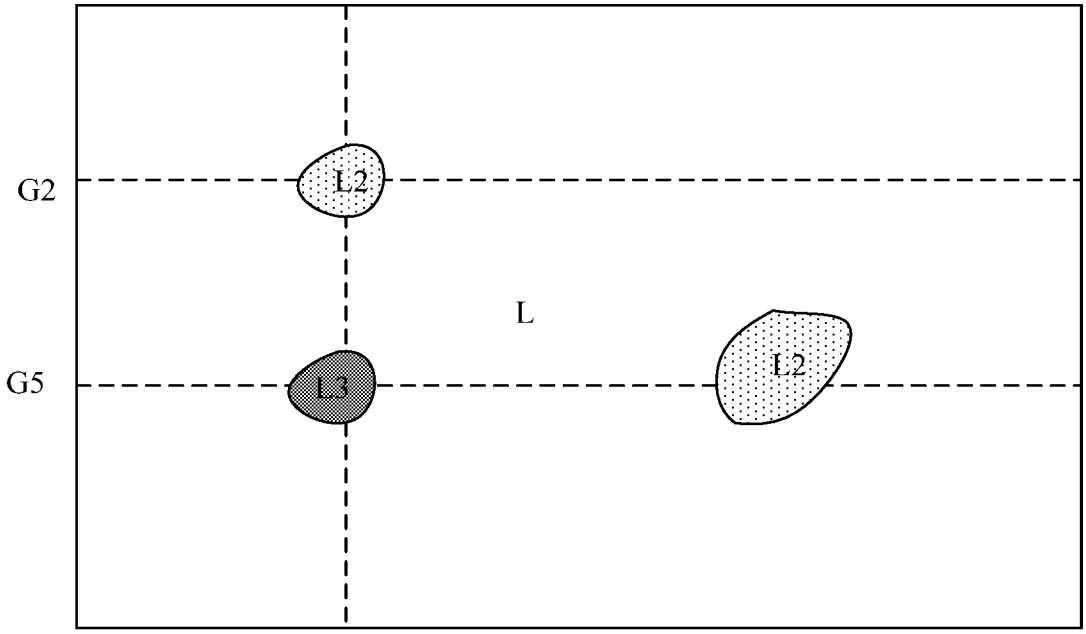
FIG. 5 is a schematic diagram illustrating brightness distribution of a display apparatus before brightness compensation in an embodiment of the present disclosure.

It should be understood that, for the display apparatus, the to-be-compensated display unit may be determined according to brightness values. In some embodiments, as shown in FIGS. 2 and 5, whether the display unit needs light emitting compensation may be determined according to brightness value ranges. For example, different brightness value ranges may be set, then the display apparatus is divided into display areas having different brightnesses according to the different brightness value ranges, and the display unit in the display area having a relatively small brightness value is determined as the to-be-compensated display unit.

It should be noted that, in the present disclosure, the to-be-compensated display unit may be located in a defective display region of the display apparatus, or may be located in a normal light emitting region (also referred to as normal display region hereinafter) of the display apparatus. In the case that the defective display region is an area having a relatively small brightness value, the display unit in the defective region is the to-be-compensated display unit; in the case that the normal light emitting region is an area having a relatively small brightness value (i.e., the defective region has a relatively large brightness value), the display unit in the normal light emitting region is the to-be-compensated display unit. Embodiments of the disclosure are described by taking the case that the to-be-compensated display unit is in the defective region as an example.

In addition, the compensation time of the to-be-compensated display unit may be determined according to the brightness value of the to-be-compensated display unit, the brightness value of a display unit (i.e., display unit that does not need compensation) other than the to-be-compensated display unit and the display time T of one frame of image. In practical, to determine the compensation time of the to-be-compensated display unit, for each of the display areas having different brightnesses, an average value of actual brightness values of the display units in the display area may be regarded as the brightness value of the display units in the display area.

Thereinafter, the specific process of determining the compensation time of the to-be-compensated display unit will be explained by taking the cases of S=2 and S=3 as examples.

The brightness $L_{target}$ of a display unit sensed by human eyes is the integration of an actual brightness value of the display unit over time, and the time is generally constant in the display process, then:

$$L_{target} = \frac{L_{init}}{t} t'$$

where t is a time of normal light emission, t' is a total time of light emission after compensation, and $L_{init}$ is an actual brightness value of the display unit.

On the basis of this, in the case of S=2 (referring to FIGS. 1 and 2), the display apparatus has only two display areas having different brightnesses: one is an area of the to-be-compensated display unit (the number of the area may be one or plural), and the other is an area of the display unit that does not need compensation, then:

$$\Delta L = L1 - L2 \tag{1}$$

$$\Delta L = \frac{L2}{t1} t2 \tag{2}$$

$$T = t1 + t2 \tag{3}$$

In the above equations, L1 and L2 are brightness values respectively outputted by a first display unit and a second display unit in the case that the first display unit and the second display unit are applied with a same pixel data, and L1>L2, the second display unit is the to-be-compensated display unit in the second turning-on (the first display unit is other display unit than the to-be-compensated display unit); T is the display time of one frame of image; t1 is a time interval between the first turning-on and the second turning-on, and t2 is a time interval between the second turning-on and the first turning-on for the next frame of image.

By combining the above equations (1), (2) and (3), the time interval t1 between the first turning-on and the second turning-on can be obtained:

$$t1 = \frac{L2}{L1} T.$$

Apparently, the time interval t2 between the second turning-on and the first turning-on for the next frame of image satisfies:

$$t2 = T - t1 = \frac{L1 - L2}{L1} T.$$

In the case of S=3 (referring to FIGS. 4 and 5), the display apparatus has three display areas having different brightnesses: two display areas having lower brightness are areas of the to-be-compensated display unit, and the display area having the largest brightness is an area of the display unit that does not need compensation. Here, each display area may include only one area, or may include a plurality of areas.

Specifically, L1, L2 and L3 are brightness values respectively outputted by a first display unit, a second display unit, and a third display unit in the case that the first display unit, the second display unit and the third display unit are applied with a same pixel data, and L1>L2>L3; T is the display time of one frame; the second display unit is the to-be-compensated display unit in the second turning-on, the third display unit is the to-be-compensated display unit in the second turning-on and the third turning-on, and the first display unit is other display unit than the to-be-compensated display unit.

According to the brightness values L1 and L3 outputted by the first display unit and the third display unit and the display time T of one frame of image, and in conjunction with the calculation principle of the above equations (1), (2) and (3), the following can be obtained:

$$t1 = \frac{L3}{L1} T.$$

On the basis of this:

$$\Delta L' = L1 - L2 \tag{4}$$

$$\Delta L' = \frac{L2}{t1} t2 \tag{5}$$

By combining the above equations (4) and (5) and $$t1 = \frac{L3}{L1} T,$$

a time interval t2 between the second turning-on and the third turning-on can be calculated as follows: t2=

$$t2 = \left(\frac{L3}{L2} - \frac{L3}{L1}\right) T.$$

A time interval t3 between the third turning-on and the first turning-on for the next frame of image is as follows:

$$t3 = T - t1 - t2 = \frac{L2 - L3}{L2}.$$

For the case that S equals to other value (i.e., each row of display units are turned on more than 3 times during the display time of one frame of image), calculation may be performed with reference to the above calculation principle, which will not be described repeatedly herein. Furthermore, because the time during which a data line inputs pixel data to the display unit is much smaller than an actual light emitting time of the display unit and is generally below 7 ms (in the case of a display frequency of 60 Hz), the light emitting time and compensated light emitting time in the display time T of one frame of image are calculate by taking the case of ignoring input time of pixel data by the data line as an example in the present disclosure. In other words, embodiments of the present disclosure are described by taking the case that the display time of one frame of image includes the light emitting time and the compensated lighting emitting time only as an example.

It should be noted that, in the display time of one frame of image, a time interval between adjacent turning-ons (i.e., between the r-th turning on and the (r+1)-th turning on, where r is an integer larger than 0 and smaller than S) can be calculated according to the above calculation method, so that brightness values of the defective display region and the normal display region sensed by human eyes are substantially the same. Needless to say, it is also possible to choose an approximate value of the value obtained by this calculation method, as long as it is ensured that a difference in the sensed brightness values of the defective display region and the normal display region is within a range of brightness difference acceptable to human eyes.

Figure 6:
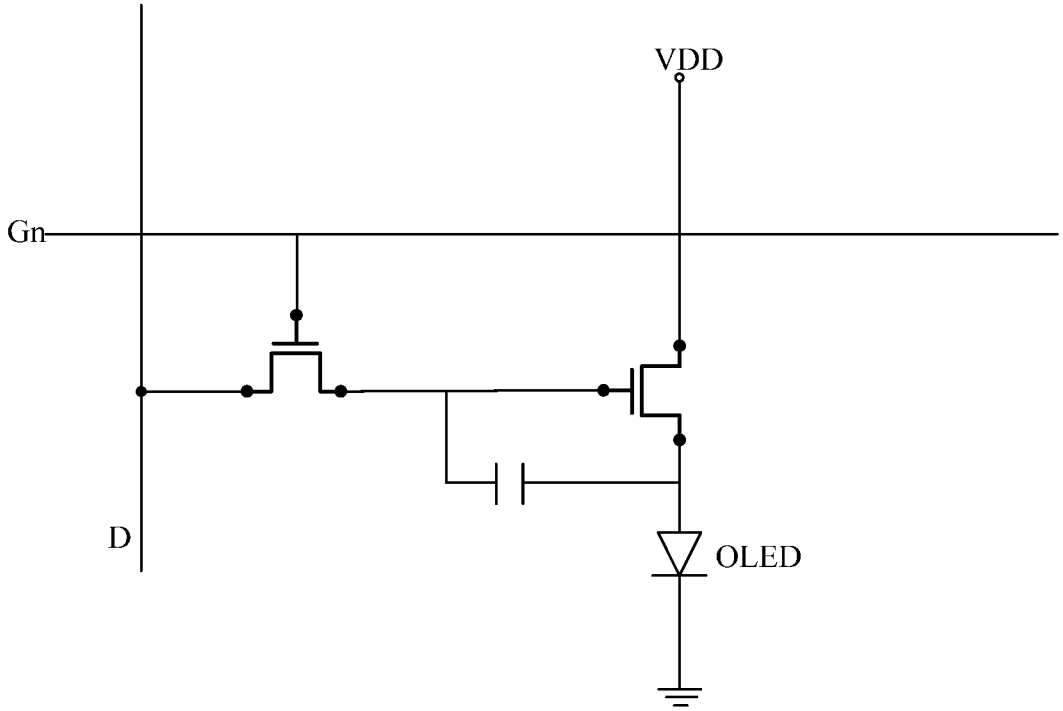
FIG. 6 is a schematic diagram of a pixel circuit of an OLED display apparatus according to an embodiment of the present disclosure.

Furthermore, it should also be noted that an electrical compensation method adopted in the prior art achieves brightness uniformity mainly by increasing or decreasing a current of a corresponding target display unit. With this compensation method, on one hand, a voltage across two terminals of an OLED device is large in the case of the largest brightness of the display unit (referring to an OLED pixel circuit in FIG. 6), in this case, it is necessary to increase a voltage inputted by the data line D to increase a drive current of the OLED device in the relatively dark area (i.e., an area of the to-be-compensated display unit in the present disclosure) when performing electrical compensation, as a result, it is likely that the voltage across two terminals of the OLED device exceeds a design value during light emission of the OLED device, which causes a drive thin film transistor to enter the linear zone and thus makes the compensation eventually fail, and at the same time, an increase in the current of the display unit also results in increased impact of IR drop; on the other hand, achieving uniformity in eventual brightness by increasing the current of the relatively dark area may easily cause the device in the relatively dark area to age faster, which is detrimental to the improvement of product life and reliability.

By contrast, in the method of compensating brightness by controlling light emitting time in the present disclosure, increasing the current on the OLED device in the prior art is avoided, and brightness uniformity can be satisfied only by prolonging or shortening the light emitting time of the OLED device, thus avoiding various disadvantages caused by the above electrical compensation.

In addition, considering the display time T of one frame of image (e.g., T=1/60s, in the case of a display frequency of 60 Hz), to avoid turning on each row of the display units too much times during the display time T of one frame of image to cause detrimental influence on display image such as image distortion, S equals to 2 or 3 in the present disclosure, that is, the row of display units are turned on twice or 3 times during the display time T of one frame of image.

In addition, it should be understood by a person skilled in the art that the brightness compensation method in the present disclosure can be used to perform brightness compensation on the display apparatus alone, or in combination with the electrical compensation method in the prior art, which is not limited in the present disclosure and can be set as required in practice.

Practical compensation of the display apparatus will be further explained below by taking the case of S=2 or 3 as examples and in conjunction with a scan frequency of scan lines and a refresh frequency of data lines in the present disclosure.

It should be understood by a person skilled in the art that when an existing display apparatus performs image display, in the process of turning on a plurality of rows of display units row by row, a scan driving circuit is generally adopted to turn on the respective rows of display units row by row and consecutively, that is, the next row of display units are turned on after turning on the current row of display units, and in the case that each row of display units are turned on, a data driving circuit controls data lines to input pixel data to each display unit in the currently turned-on row, that is, corresponding pixel data is inputted to the next row of display units after corresponding pixel data is inputted to the current row of display units.

However, the design scheme of the present disclosure differs from that of the prior art in the following way.

Because in the time T of one frame of image, the display units are turned on row by row twice or 3 times (in the present disclosure, turning on the display units row by row once is also referred to as one scanning of the display units, and accordingly turning on the display units row by row S times is referred to as S scannings of the display units), 2 or 3 rows of display units may be turned on at the same time if a conventional scan driving method is adopted, so that the data lines simultaneously input the same pixel data to plural rows of display units at that time and in turn the display apparatus is unable to display normally.

Therefore, in the present disclosure, it is ensured that the data lines can input pixel data to a single row of display units that is currently turned-on at different times when the display units are turned on row by row for different times during the display time T of one frame of image, so as to ensure normal display of an image. To this end, in the present disclosure, during the display time T of one frame of image, for each scanning of the display units, a time interval between turning-ons of any adjacent rows is controlled to be a same value, and meanwhile, the data lines are set to be refreshed S×n times in the display time T of one frame of image, wherein the data lines are refreshed (S−1) times in the time interval between the same turning-ons of any two adjacent rows of display units (i.e., between turning-ons of any two adjacent rows of display units in a same scanning). In other words, for a same scanning, the data lines are refreshed at the turning-on time of the current row, refreshed at the turning-on time of the next row, and refreshed (S−1) times between the turning-on time of the current row and the turning-on time of the next row (i.e., (S−1) times of refreshment are inserted).

It should be noted that: for n rows of display units, S scannings are not performed in sequence. For example, in the case of S=2, as shown in FIGS. 1 and 3, sequentially turning on the n rows of display units for the first time (i.e., the first scanning) starts first, then sequentially turning on the n rows of display units for the second time (i.e., the second scanning) starts after the time interval t1, at this time, however, the first scanning is still in progress, and at any time, only one row of display units are turned on to ensure that only one row of display units are applied with pixel data or compensation data for display or compensation through the data lines. In some embodiments, scanning frequencies of the first scanning and the second scanning may be the same, in this way, for a same scanning, there is a time interval Δt between turning-on times of any two adjacent rows, and the turning-on time of each row of display units in the second scanning is in the time interval Δt between turning-on times of adjacent rows in the first scanning (i.e., the starting time of the second scanning is inserted in the time interval Δt between turning-on times of adjacent rows). Besides, the time at which each row of display units are scanned (turned on) needs to match with the time at which the data lines are refreshed, so that when one row of display units are turned on in each scanning, corresponding data signals are inputted to the row of display units through the data lines.

Figure 4:
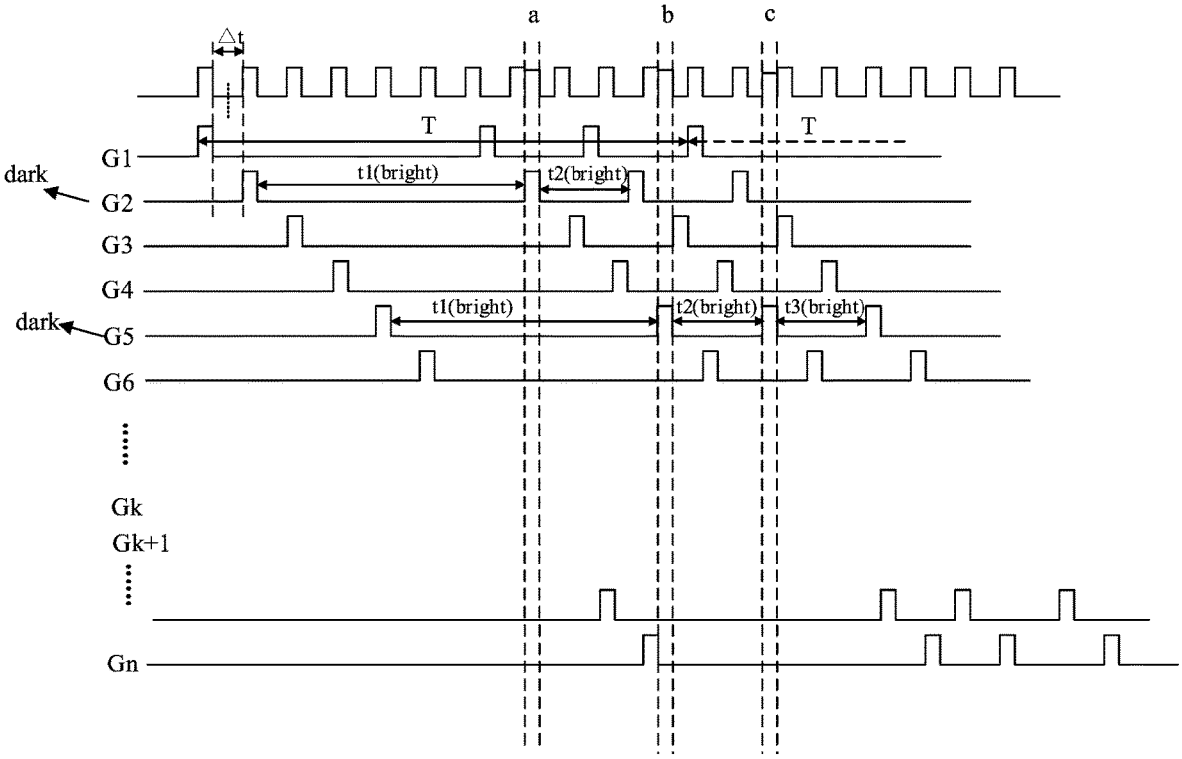
FIG. 4 is a schematic diagram of a brightness compensation method for a display apparatus provided in an embodiment of the present disclosure.

In the case of S=3, as shown in FIG. 4, the first scanning starts first, then the second scanning starts after the time interval t1 (the first scanning is still in progress), and the third scanning starts after the time interval t2 (at this time, the first scanning and the second scanning are still in progress). At any time, only one row of display units are turned on. For example, the turning-on times of respective rows of display units in the second scanning and the third scanning are in the time interval Δt between turning-on times of adjacent rows in the first scanning (i.e., the turning-on times of the second scanning and the turning-on times of the third scanning are inserted in the time interval Δt between turning-on times of adjacent rows) and do not overlap with each other. For example, the time interval Δt between turning-on times of adjacent rows is divided into two segments, the first segment is for insertion of the second scanning and the second segment is for insertion of the third scanning. Similarly, the time at which each row of display units are scanned (turned on) needs to match with the time at which the data lines are refreshed, so that when one row of display units are turned on in each scanning, corresponding data signals are inputted to the row of display units through the data lines.

In practical use, S different drivers may be used to implement S scannings. For example, each driver is used to implement one scanning. S different drivers turn on only one row of display units at the same time.

In one embodiment, as shown in FIG. 1, S=2, and in the display time T of one frame of image, during each scanning of display units, the data lines are refreshed once (i.e., the number of inserted refreshment is one) in the time interval Δt between turning-on times of any two adjacent rows, that is, in the display time T of one frame of image, the data lines are refreshed 2n (S×n) times, which allows signals (including the compensation signal and the voltage signal of 0V) to be inputted to the display units through the data lines when the rows of display units are turned on row by row for the second time. In this way, it is ensured that in the display time T of one frame of image, pixel data is inputted through data lines to a single row of display units that is currently turned on, while the display units are turned on row by row for the first time and the second time.

For example, in the case that the to-be-compensated display unit in the fifth row in FIG. 1 (combined with FIG. 2) is compensated, when the row of display units are turned on for the second time, the data lines are refreshed (i.e., inserted refreshment) at time a between the first turning-on of the second row and the first turning-on of the third row for the next frame of image, the to-be-compensated display unit in the fifth row is applied with pixel data (compensation data) through the data line, and other display unit than the to-be-compensated display unit is applied with the voltage signal of 0V, thereby ensuring normal display of an image.

Similarly, for the case of S=3, as shown in FIG. 4, in the display time T of one frame of image, for each scanning of display units, the data lines are refreshed twice (i.e., the number of inserted refreshment is two) in the time interval Δt between turning-on times of adjacent rows, that is, in the display time T of one frame, the data lines are refreshed 3n (S×n) times, which allows signals to be inputted to the display units through the data lines when the rows of display units are turned on row by row for the second time and for the third time. In this way, it is ensured that in the display time T of one frame of image, pixel data can be inputted through data lines to a single row of display units that is currently turned on, while the display units are turned on row by row for the first time, the second time and the third time.

For example, in the case that the to-be-compensated display unit in the second row in FIG. 4 (combined with FIG. 5) is compensated, when the row of display units are turned on for the second time, the data lines are refreshed (i.e., the first refreshment among the two inserted refreshments) at time a between the first turning-on of the k-th row of display units and the first turning-on of the (k+1)-th row of display units, the to-be-compensated display unit in the second row is applied with pixel data (compensation data) through the data line, and other display unit than the to-be-compensated display unit in the row inputs the voltage signal of 0V. For the to-be-compensated display unit in the fifth row, when the row of display units are turned on for the second time, the data lines are refreshed (i.e., the first refreshment among the two inserted refreshments) at time b between the first turning-on of the n-th row of display units and the first turning-on of the first row of display units for an adjacent frame of image, the to-be-compensated display unit in the fifth row is applied with pixel data (compensation data) through the data line, and other display unit than the to-be-compensated display unit in the row is applied with the voltage signal of 0V.

In addition, for the to-be-compensated display unit in the fifth row that needs to be further compensated in the third turning on (i.e., the to-be-compensated display unit in the fifth row that is darker than the other to-be-compensated display unit in the second turning on), when the row of display units are turned on for the third time, the data lines are refreshed (i.e., the second refreshment among the two inserted refreshments) at time c between the first turning-on of the second row of display units and the first turning-on of the third row of display units for the next frame of image, the to-be-compensated display unit in the fifth row is applied with pixel data (compensation data) through the data line, and other display unit than the to-be-compensated display unit in the row is applied with the voltage signal of 0V.

It should be noted that, although the data lines are refreshed S×n times, display of the display units will not be affected no matter what signals the data lines are loaded when no display units are turned on, because not in every time interval Δt between turning-on times of adjacent rows, one row of display units are turned on. Thus, the signals loaded onto the data lines when no display units are turned on are not limited in the present disclosure.

It should be understood that, with the technical solutions of the present disclosure, in the case that the display panel has only one type of relatively dark area in a row direction or a column direction (i.e., there are only two brightness values in the row direction or the column direction, and FIG. 2 may be referred to), the brightness compensation in the present disclosure can be achieved when S is set as 2; in the case that the display panel has two types of relatively dark areas in the row direction or the column direction (i.e., there are three brightness values in the row direction or the column direction, and FIG. 5 may be referred to), the brightness compensation in the present disclosure can be achieved when S is set as 3.

Embodiments of the present disclosure further provide a display apparatus including n rows of display units (n is an integer greater than or equal to 2), and the display apparatus further includes:

a scan driving circuit configured to, for each row of display units, turn on the row of display units S times during a display time of one frame of image; and a data driving circuit configured to input, to each display unit in the row of display units, a pixel data signal of the frame of image corresponding to the display unit, when the row of display units are turned on for the i-th time; the data driving circuit is further configured to input, to a to-be-compensated display unit in the row of display units, a compensation signal, and control other display unit than the to-be-compensated display unit to present black, when the row of display units are turned on for each time other than the i-th time; wherein S is an integer greater than or equal to 2, the i-th time is one of the S times; for every two adjacent rows of display units, a time interval between same turning-ons of the latter row and the former row is the same.

By adopting the display apparatus in the present disclosure, light emitting time of the display unit in a relatively dark area (i.e., the to-be-compensated display unit) is prolonged, so that as compared with a display unit in a relatively bright area, the display unit in the relatively dark area continues emitting light for a corresponding compensated light emitting time after normally emitting light for a same time. In this way, as a whole, the brightness of the display unit in the relatively dark area sensed by human eyes is the same as the brightness of the display unit in the relatively bright area sensed by human eyes, thus alleviating the problem of non-uniformity in light emission of the display apparatus.

Further, the scan driving circuit includes S scan driving sub-circuits configured to, for each row of display units, sequentially turn on the row of display units S times during the display time of one frame of image. In an embodiment, each of the S scan driving sub-circuit turns on the row of display units once (i.e., performs one scanning), S scan driving sub-circuits perform scanning at a same frequency, and do not perform scanning at the same time. In other words, at any scanning time, only one scan driving sub-circuit operates to turn on only one row of display units.

In the embodiment of the present disclosure, the scan driving circuit may be a gate driver on array (GOA) circuit, or may be a scan driving IC. In the case that the scan driving circuit is a GOA circuit, S scan driving sub-circuits are S groups of GOA units, wherein one group of GOA units refer to a group of GOA units that can perform whole screen scanning of the n rows of display units in the display apparatus; in the case that the scan driving circuit is a scan driving IC, S scan driving sub-circuits may be S scan driving ICs, or S scan driving circuits are integrated in one IC. The present invention is not limited thereto, and settings may be made as actually required.

In order to avoid turning on the display unit too many times during the display time T of one frame of image to cause detrimental influence on display image, S equals to 2 or 3 in the present disclosure.

In order to ensure that only one row of display units that is currently turned on is applied with pixel data through data lines when the display units are turned on row by row during the display time T of one frame of image to ensure normal image display, in one embodiment, the data lines are refreshed S×n times by the data driving circuit during the display time T of one frame of image; during an interval between the same turning-ons of any two adjacent rows of display units, the data lines are refreshed (S−1) times.

In addition, in the case that S equals to 2, a time interval t1 between the first turning-on and the second turning-on satisfies:

$$t1 = \frac{L2}{L1}T;$$

time interval t2 between the second turning-on and the first turning-on for the next frame of image satisfies:

$$t2 = T - t1 = \frac{L1 - L2}{L1}T.$$

L1 and L2 are brightness values respectively outputted by a first display unit and a second display unit in the case that the first display unit and the second display unit are applied with a same pixel data, and L1>L2; T is the display time of one frame of image; the second display unit is the to-be-compensated display unit in the second turning-on.

In the case that S equals to 3:

a time interval t1 between the first turning-on and the second turning-on satisfies:

$$t1 = \frac{L3}{L1}T;$$

a time interval t2 between the second turning-on and the third turning-on satisfies:

$$t2 = \left(\frac{L3}{L2} - \frac{L3}{L1}\right)T;$$

a time interval t2 between the third turning-on and the first turning-on for the next frame of image satisfies:

$$t3 = T - t1 - t2 = \frac{L2 - L3}{L2}.$$

L1, L2 and L3 are brightness values respectively outputted by a first display unit, a second display unit, and a third display unit in the case that the first display unit, the second display unit and the third display unit are applied with a same pixel data, and L1>L2>L3; T is the display time of one frame of image; the second display unit is the to-be-compensated display unit in the second turning-on, and the third display unit is the to-be-compensated display unit in the second turning-on and the third turning-on.

In some embodiments, the display apparatus further includes a to-be-compensated display unit determining module configured to determine the to-be-compensated display unit and including an image sensor and a determination unit. The data driving circuit inputs a same pixel data to all the display units of the display apparatus so that the display apparatus displays a detection image. The image sensor is configured to obtain brightness values of the display units in the detection image. The determination unit is configured to determine the to-be-compensated display unit based on the brightness values obtained by the image sensor. The determination unit may be implemented as a processor and a memory, the memory is configured to store a preset threshold value and executable instructions, and the processor is configured to execute the instructions stored in the memory to determine the display unit having a brightness value smaller than the preset threshold value to be the to-be-compensated display unit and store the to-be-compensated display unit (e.g., position information thereof) in the memory. Alternatively, the memory is configured to store preset different brightness value ranges and executable instructions, and the processor is configured to execute the instructions stored in the memory to divide the display apparatus into display areas having different brightnesses and determine the display unit in a display area having a relatively small brightness value to be the to-be-compensated display unit and store the to-be-compensated display unit (e.g., position information thereof) in the memory.

It should be noted herein that the display apparatus may at least be a liquid crystal display apparatus or an organic light emitting diode display apparatus. For example, the display apparatus may be any product or component with a display function, such as a liquid crystal display, a liquid crystal television, a digital photo frame, a mobile phone, a tablet computer or the like.

In addition, the display apparatus is a specific apparatus using the foregoing brightness compensation method, and has features corresponding to the brightness compensation method. Thus, for details in the embodiments of the display apparatus, the forgoing method embodiments may be referred to, and repeated description is omitted herein.

The above description is merely specific embodiments of the present disclosure, but the protection scope of the present disclosure is not limited thereto. Various variations or displacements that are easily conceivable to those skilled in the art within the technical scope disclosed by the present disclosure shall be regarded as falling into the protection scope of the present disclosure. Therefore, the protection scope of the present disclosure should be determined by the appended claims.

The invention claimed is:

1. A brightness compensation method for a display apparatus, the display apparatus comprising n rows of display units, where n is an integer no less than 2, wherein the brightness compensation method comprises: for each row of display units, turning on the row of display units S times during a display time of one frame of image;

inputting, to each display unit in the row of display units, a pixel data signal of the frame of image corresponding to the display unit, when the row of display units are turned on for the i-th time; and inputting a compensation signal to a to-be-compensated display unit in the row of display units, and controlling other display unit than the to-be-compensated display unit in the row of display units to present black, when the row of display units are turned on for each time other than the i-th time;

wherein both S and i are integers, $S \geq 2$, $1 \leq i \leq S$; for every two adjacent rows of display units, a time interval between same turning-ons of the latter row and the former row is the same;

wherein S equals to 3;

a time interval t1 between the first turning-on and the second turning-on of the row of display units equals to $$\frac{L3}{L1}T;$$

a time interval t2 between the second turning-on and the third turning-on of the row of display units equals to $$\left(\frac{L3}{L2}-\frac{L3}{L1}\right)T;$$

where L1, L2 and L3 are brightness values respectively outputted by a first display unit, a second display unit, and a third display unit in the case that the first display unit, the second display unit and the third display unit are applied with a same pixel data, respectively, and L1>L2>L3, T is the display time of one frame of images, the second display unit is the to-be-compensated display unit in the second turning-on, the third display unit is the to-be-compensated display unit in the second turning-on and the third turning-on, and the first display unit is other display unit than the to-be-compensated display unit.

2. The brightness compensation method of claim 1, wherein the step of inputting, to each display unit in the row of display units, a pixel data signal of the frame of image corresponding to the display unit when the row of display units are turned on for the i-th time comprises:

inputting, to each display unit in the row of display units, a pixel data signal of the frame of image corresponding to the display unit when the row of display units are turned on for the first time.

3. The brightness compensation method of claim 1, wherein the display apparatus includes a plurality of data lines, the plurality of data lines are refreshed S×n times during the display time of one frame of image; and in the time interval between the same turning-ons of any two adjacent rows of display units, the data lines are refreshed (S−1) times.

4. The brightness compensation method of claim 1, further comprising a step of determining the to-be-compensated display unit, wherein the step of determining the to-be-compensated display unit comprises:

inputting a same pixel data to all the display units of the display apparatus so that the display apparatus displays a detection image;

obtaining, by an image sensor, brightness values of the display units in the detection image; and determining the to-be-compensated display unit based on the brightness values.

5. The brightness compensation method of claim 4, wherein determining the to-be-compensated display unit based on the brightness values comprises: determining a display unit whose brightness value is less than a preset threshold value to be the to-be-compensated display unit; or dividing the display apparatus into display areas having different brightnesses according to different brightness value ranges that are preset; and determining a display unit that is in a display area having a relatively small brightness value to be the to-be-compensated display unit.

6. The brightness compensation method of claim 1, wherein for the row of display units, the display time of one frame of image is a time between a time when the row of display units are turned on for the (m×S+1)-th time and a time when the row of display units are turned on for the ((m+1)×S+1)-th time, where m is an integer no less than 0.

7. The brightness compensation method of claim 1, wherein for the n rows of display units, only one row of display units are turned on at the same time.

8. A display apparatus, comprising n rows of display units, where n is an integer no less than 2, the display apparatus further comprising:

a scan driving circuit configured to, for each row of display units, turn on the row of display units S times during a display time of one frame of image; and a data driving circuit configured to input, to each display unit in the row of display units, a pixel data signal of the frame of image corresponding to the display unit through data lines, when the row of display units are turned on for the i-th time;

wherein the data driving circuit is further configured to input, to a to-be-compensated display unit in the row of display units, a compensation signal through the data lines, and control other display unit than the to-be-compensated display unit in the row of display units to present black, when the row of display units are turned on for each time other than the i-th time; and wherein both S and i are integers, $S \geq 1$, $1 \leq i \leq S$; for every two adjacent rows of display units, a time interval between same turning-ons of the latter row and the former row is the same;

wherein S equals to 3, and the scan driving circuit is configured to set:

a time interval t1 between the first turning-on and the second turning-on of the row of display units to equal to $$\frac{L3}{L1}T;$$

and a time interval t2 between the second turning-on and the third turning-on of the row of display units to equal to $$\left(\frac{L3}{L2} - \frac{L3}{L1}\right)T;$$

where L1, L2 and L3 are brightness values respectively outputted by a first display unit, a second display unit, and a third display unit in the case that the first display unit, the second display unit and the third display unit are applied with a same pixel data, and L1>L2>L3; T is the display time of one frame of image; the second display unit is the to-be-compensated display unit in the second turning-on, the third display unit is the to-be-compensated display unit in the second turning-on and the third turning-on, and the first display unit is other display unit than the to-be-compensated display unit.

9. The display apparatus of claim 8, wherein the scan driving circuit comprises S scan driving sub-circuits configured to, for each row of display units, sequentially turn on the row of display units S times during the display time of one frame of image, and the S scan driving sub-circuits turn on only one row of display units at the same time.

10. The display apparatus of claim 8, wherein the data driving circuit is configured to input, to each display unit in the row of display units, a pixel data signal of the frame of image corresponding to the display unit when the row of display units are turned on for the first time.

11. The display apparatus of claim 8, wherein the data lines are refreshed S×n times by the data driving circuit during the display time of one frame of image; and in the time interval between the same turning-ons of any two adjacent rows of display units, the data lines are refreshed (S−1) times.

12. The display apparatus of claim 8, further comprising a to-be-compensated display unit determining module comprising an image sensor and a determination unit, wherein the data driving circuit inputs a same pixel data to all the display units of the display apparatus so that the display apparatus displays a detection image;

the image sensor is configured to obtain brightness values of the display units in the detection image; and the determination unit is configured to determine the to-be-compensated display unit based on the brightness values.

13. The display apparatus of claim 12, wherein the determination unit is configured to determine a display unit whose brightness value is less than a preset threshold value to be the to-be-compensated display unit; or divide the display apparatus into display areas having different brightnesses according to different brightness value ranges that are preset; and determine a display unit that is in a display area having a small brightness value to be the to-be-compensated display unit.

14. The display apparatus of claim 12, wherein for the row of display units, the display time of one frame of image is a time between a time when the row of display units are turned on for the (m×S+1)-th time and a time when the row of display units are turned on for the ((m+1)×S+1)-th time, where m is an integer no less than 0.

* * * * *